US010907899B1

(12) United States Patent
Lanclos

(10) Patent No.: US 10,907,899 B1
(45) Date of Patent: Feb. 2, 2021

(54) REFRACTORY ANCHOR

(71) Applicant: Christopher P. Lanclos, Kemah, TX (US)

(72) Inventor: Christopher P. Lanclos, Kemah, TX (US)

( * ) Notice: Subject to any disclaimer, the term of this patent is extended or adjusted under 35 U.S.C. 154(b) by 0 days.

(21) Appl. No.: 16/285,903

(22) Filed: Feb. 26, 2019

(51) Int. Cl.
*F27D 1/14* (2006.01)
*F27D 1/00* (2006.01)
*E04B 1/41* (2006.01)

(52) U.S. Cl.
CPC ..... *F27D 1/004* (2013.01); *E04B 1/40* (2013.01)

(58) Field of Classification Search
CPC .. F27D 1/141; F27D 1/10; F27D 1/004; B01J 2219/0218; F23M 5/04; E04B 1/40
See application file for complete search history.

(56) References Cited

U.S. PATENT DOCUMENTS 4,479,337 A 10/1984 Crowley
4,581,867 A 4/1986 Crowley
4,651,487 A 3/1987 Nishikawa
4,660,343 A 4/1987 Raycher et al.
4,680,908 A 7/1987 Crowley
4,711,186 A 12/1987 Chen et al.
4,753,053 A 6/1988 Heard
D375,892 S * 11/1996 Kraemer, Jr. ..... D8/384
D393,588 S * 4/1998 Tuthill ..... D8/384
6,393,789 B1 5/2002 Lanclos
9,861,949 B2 * 1/2018 Simon ..... B32B 3/12
10,352,619 B2 * 7/2019 Yoder ..... B01J 19/0053
10,508,861 B1 * 12/2019 D'Oracio De Almeida ..... F23M 5/04
2018/0345401 A1 * 12/2018 Giaramita ..... B23K 9/201

* cited by examiner

*Primary Examiner* — Brian E Glessner
*Assistant Examiner* — Daniel J Kenny
(74) *Attorney, Agent, or Firm* — Bushman Werner, P.C.

(57) ABSTRACT

A monolithic refractory anchor which has a bridge portion and first and second V-shaped end portions attached to opposite ends of the bridge portion. The anchor has a pedestal located generally centrally of the anchor which extends below the bottom surfaces of the wing portions of the V-shaped sections, the pedestal forming a single welding attachment point for attachment, preferably by stud welding, to a metal substrate.

13 Claims, 7 Drawing Sheets

REFRACTORY ANCHOR

FIELD OF THE INVENTION

The present invention relates to anchors for refractory linings in process equipment and, particularly, to monolithic anchors which allow maximum coverage of substrates to which the refractory material is applied.

BACKGROUND OF THE INVENTION

Refractory linings have been used for many years in process vessels, reactors, conduits, furnaces and the like, to provide thermal insulation, and in environments such as fluidized catalytic reactors or regenerators or stacks, to provide resistance to abrasion or erosion. Such linings serve not only to thermally insulate a shell or other surface, but also to prolong its service life by shielding it from erosion by abrasion. Common refractories include refractory cement, a concrete cement-aggregate mixture, or a reinforced cement or concrete.

To retain the refractory on the metal surface, various anchoring arrangements have been employed. For example, hexagonal stud grating, and weldable studs have been used. Further, the prior art abounds with various types of anchors as disclosed for example in U.S. Pat. Nos. 4,711,186; 4,753,053; 4,479,337; 4,581,867; 4,680,908; 4,660,343; 4,651,487; and 6,393,789 (789 Patent), all of which are incorporated herein by reference for all purposes. In particular, the 789 Patent discloses a highly useful refractory anchor which has been met with widespread commercial success, but which has certain drawbacks.

For one, the anchor of the 789 Patent is of two piece construction and it is necessary to clip the two pieces together prior to installing the anchor. Further, the anchor of the 789 Patent is fabricated and is relatively labor intensive to make requiring jigs and fixtures to carry out the various fabrication techniques required to form the anchor sections. In addition, the fabricated anchor of the 789 Patent has three feet forming weldable appendages which engage, and are welded to, the metal of the vessel or the like, but which make uniform application of the refractory material in the vessel wall more difficult.

SUMMARY OF THE INVENTION

In one aspect, the present invention relates to a refractory anchor which is monolithic.

In a further aspect, the present invention relates to a solid, monolithic refractory anchor which allows maximum, uniform coverage of the refractory material on the substrate to which the anchor is welded.

In yet a further aspect, the present invention relates to a monolithic refractory anchor wherein only a single weld is required to attach the refractory anchor to the metal substrate.

These and further features and advantages of the present invention will become apparent from the following detailed description, wherein reference is made to the figures in the accompanying drawings.

DETAILED DESCRIPTION OF PREFERRED EMBODIMENTS

Figure 3:
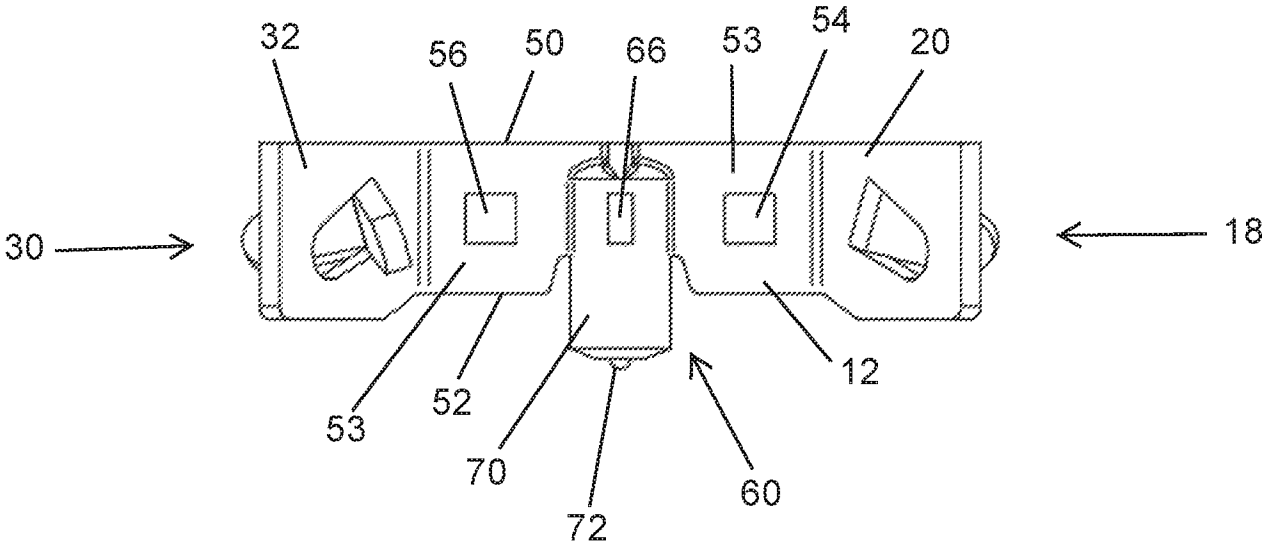
FIG. 3 is a side elevational view of the anchor of FIG. 1.

The terms "upwardly," "downwardly," "top," "bottom," and similar terms of orientation as used herein are with reference to the anchor as it is depicted in FIG. 3. Thus, "top" or "upwardly" refers to the direction towards the top of the page on FIG. 3 and "bottom" or "downwardly" refers to the direction towards the bottom of the page on FIG. 3. This orientation is for the purposes of describing the invention and does not require that the anchor, in practice, be facing such a direction. It will be understood by those skilled in the art, that the "bottommost" surfaces of the anchor may be sideways or even facing upwardly when positioned in a vessel.

The refractory anchor of the present invention is a solid, monolithic structure which can be made by any number of casting techniques used in forming metal parts such as, for example, lost-wax casting (investment casting), plaster mold casting, sand casting, etc. Methods of casting metal parts are well known to those skilled in the art and need not be described in detail here. The cast or monolithic anchors of the present invention can be made from a variety of metals which can be attached by welding or similar techniques to a metal substrate, e.g. the walls of a reaction vessel. Preferably, however, the anchors of the present invention are cast from stainless steel, e.g., 304 stainless steel.

Figure 1:
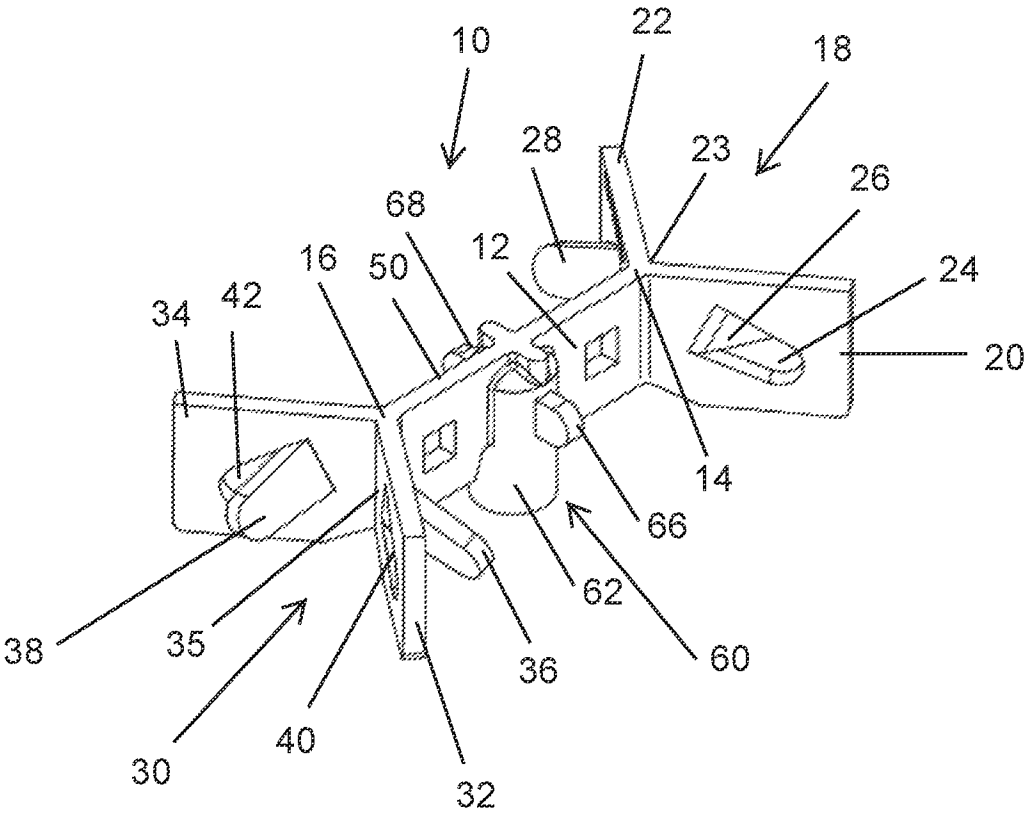
FIG. 1 is a perspective view of one embodiment of the anchor of the present invention.
Figure 4:
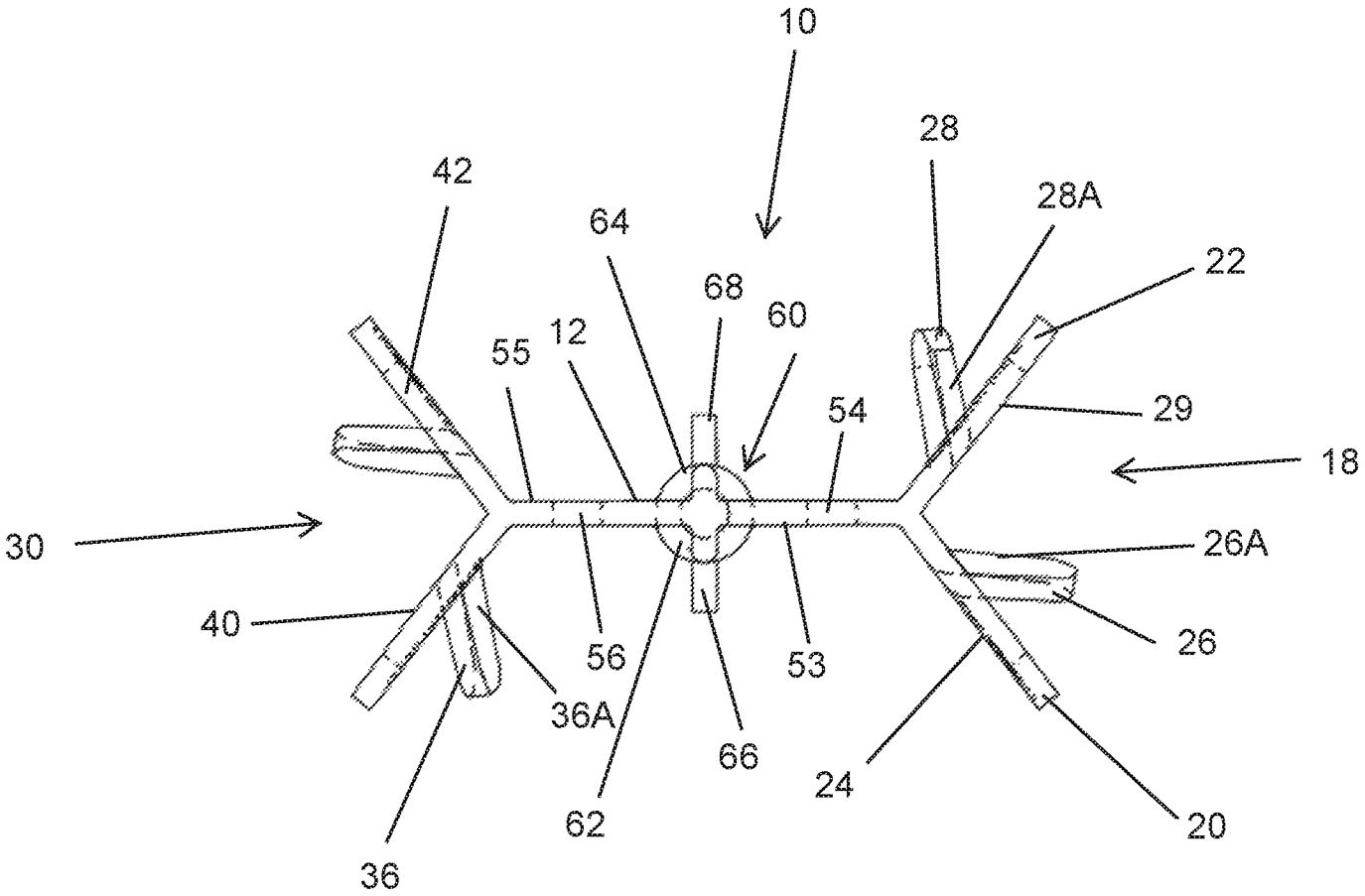
FIG. 4 is a top plan view of the anchor of FIG. 1.

Referring then to FIG. 1, the anchor, shown generally as 10, comprises a bridge portion 12 having a first end 14 and a second end 16. Extending from first end 14 of bridge portion 12 is a first V-shaped end portion shown generally as 18, which has first and second wing portions 20 and 22, respectively, which converge at a vertice portion 23 which formed on end 14 of bridge portion 12. First wing portion 20 has an aperture 24 extending therethrough and a tab 26 extending laterally outwardly from first wing portion 20. In like fashion, second wing portion 22 has a tab 28 extending laterally outwardly from second wing portion 22, and as best seen in FIG. 4, has an aperture 29 therethrough. As depicted in FIG. 4, the anchor 10, in general, has an elongated X shape.

There is a second V-shaped end portion shown generally as 30 which extends from second end 16 of bridge portion 12. Second end portion 30, has third and fourth wing portions 32 and 34, respectively, which converge at a vertice portion 35 and which have laterally extending tabs 36 and 38, respectively, as well as apertures 40 and 42, respectively.

As can be seen with reference to FIGS. 1-4, tabs 26, 28, 36, and 38, as well as apertures 24, 30, 40, and 42, are angled slightly downwardly when viewed in side elevation which, as best seen in FIG. 4, results in tabs 26, 28, 36, and 38 having surfaces 26A, 28A, 36A, and 38A, respectively, which face generally upwardly when viewed in top plan view. Accordingly, there are opposing downwardly facing surfaces on the tabs 28-38.

Referring now to FIGS. 1-4, it can be seen that bridge portion 12 has a top surface 50, a bottom surface 52, a first side surface 53, and a second side surface 55. First and second apertures 54 and 56 extend through bridge portion 12. There is a pedestal, shown generally as 60, formed on and extending from bridge portion 12, generally midway between first end portion 18 and second end portion 30. Pedestal 60 is bifurcated having a first fork 62 extending laterally outwardly from first side surface 53 of bridge portion 12 and, a second fork 64 extending laterally outwardly from second side surface 55. Projecting laterally outwardly from fork 62 of pedestal 60 is a first tab 66, while a second tab 68 projects laterally outwardly from fork 64 of pedestal 60.

Figure 2:
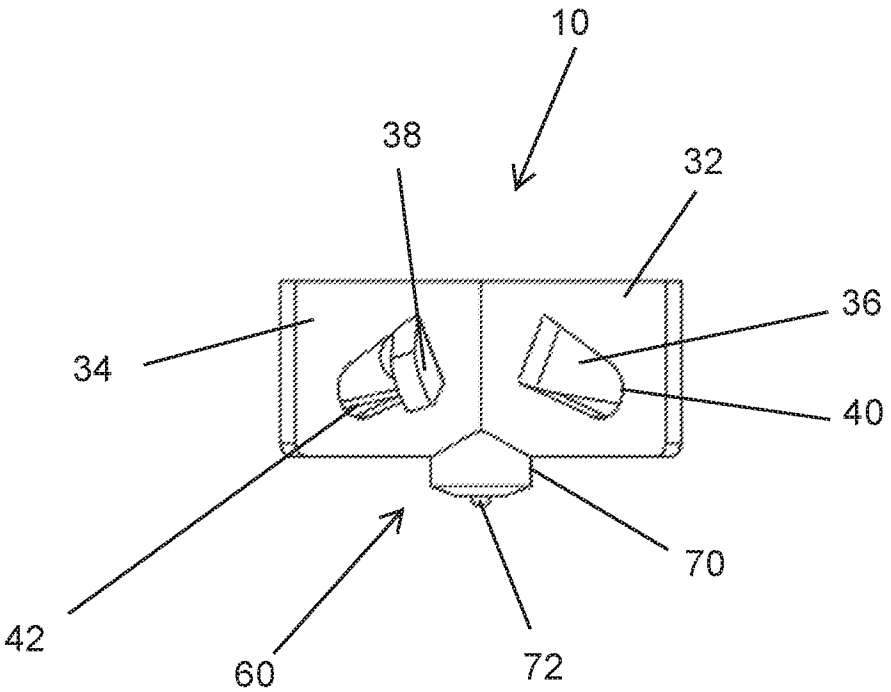
FIG. 2 is an end, elevational view of the anchor of FIG. 1.

As best seen in FIGS. 2 and 3, pedestal 60 has a generally cylindrical portion 70 proximal its lower end, pedestal 60 terminating at its lowermost end in a nub or protuberance 72 for purposes hereinafter described.

Figure 5:
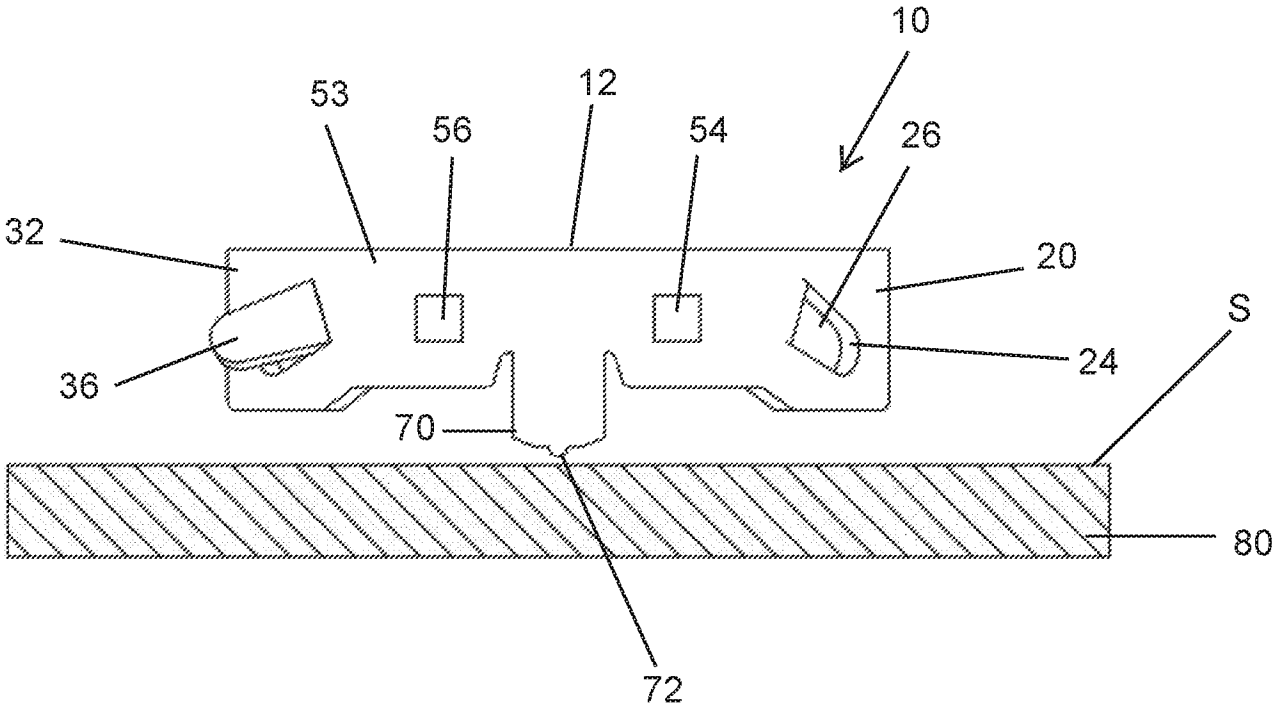
FIG. 5 is an environmental view showing the anchor of FIG. 1 prior to be welded to a metal substrate.

Referring now to FIG. 5, there is shown a portion of a metal substrate 80 having a surface S which could be the wall of a vessel, conduit, or the like. Positioned above surface S is an anchor 10 according to one embodiment of the present invention. As seen in FIG. 5, in the pre-installed position, protuberance 72 is above the surface S of substrate 80.

Figure 6:
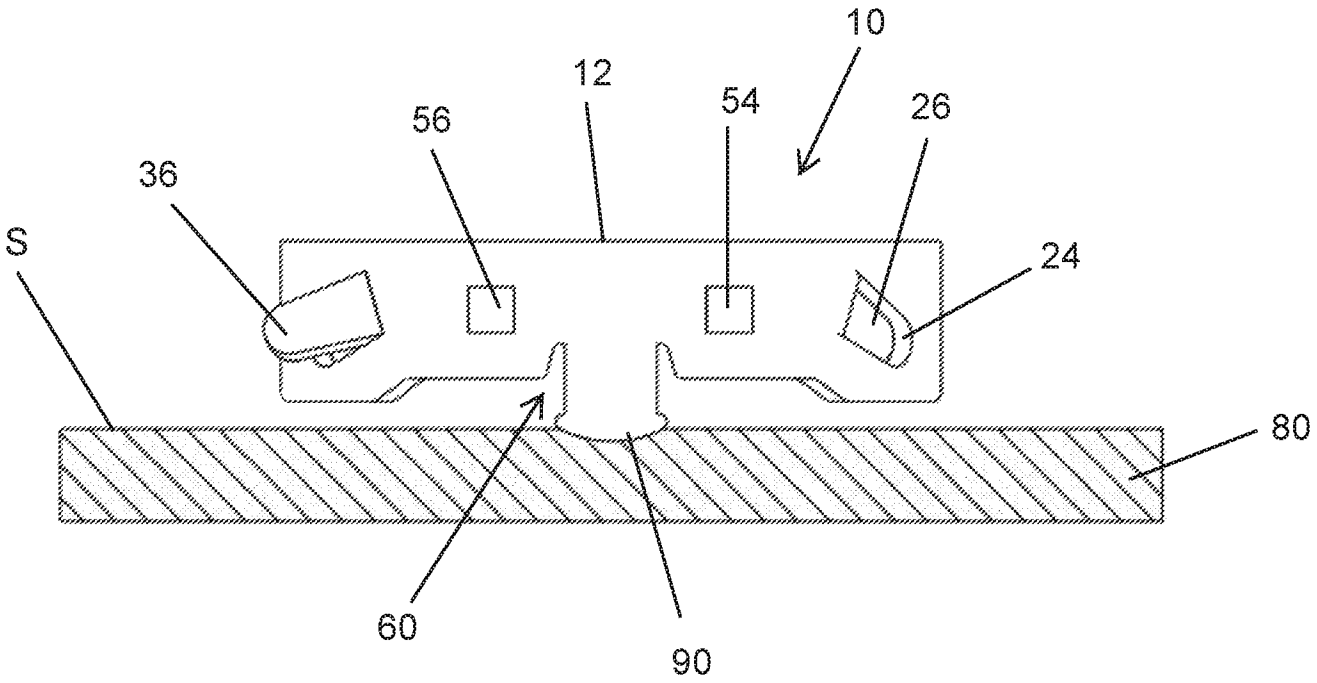
FIG. 6 is a view similar to FIG. 5 but showing the anchor after it has been attached to the substrate.

Turning now to FIG. 6, there is shown the anchor 10 after it has been welded to the surface S of substrate 80. Preferably anchor 10 is welded to substrate 80 by stud welding. Stud welding creates a full face weld melding the bottommost portion of the pedestal 60 with the metal of the substrate 80 forming a meld 90 which as can be seen only effects the surface S of the substrate 80 and not the opposing surface. It is to be understood however that instead of stud welding, stick welding or other types of welding can be used to fasten the anchors 10 to the substrate 80.

As can be seen in FIG. 6, when the anchor 10 is welded to substrate 80, all other surfaces of the anchor 10, other than the melded portion of the pedestal 60, are spaced from the surface S of the substrate 80. Thus, only a single weld is required and since it is a full cross-sectional weld, the full bottommost face of the pedestal 60 is welded into place providing a strong, worry-free weld. Other than requiring only a single weld, it can be seen that since all other surfaces other than the pedestal are spaced from the surface S of the substrate 80, the refractory material can be spread uniformly by techniques such as spraying, gunning, etc.

Figure 7:
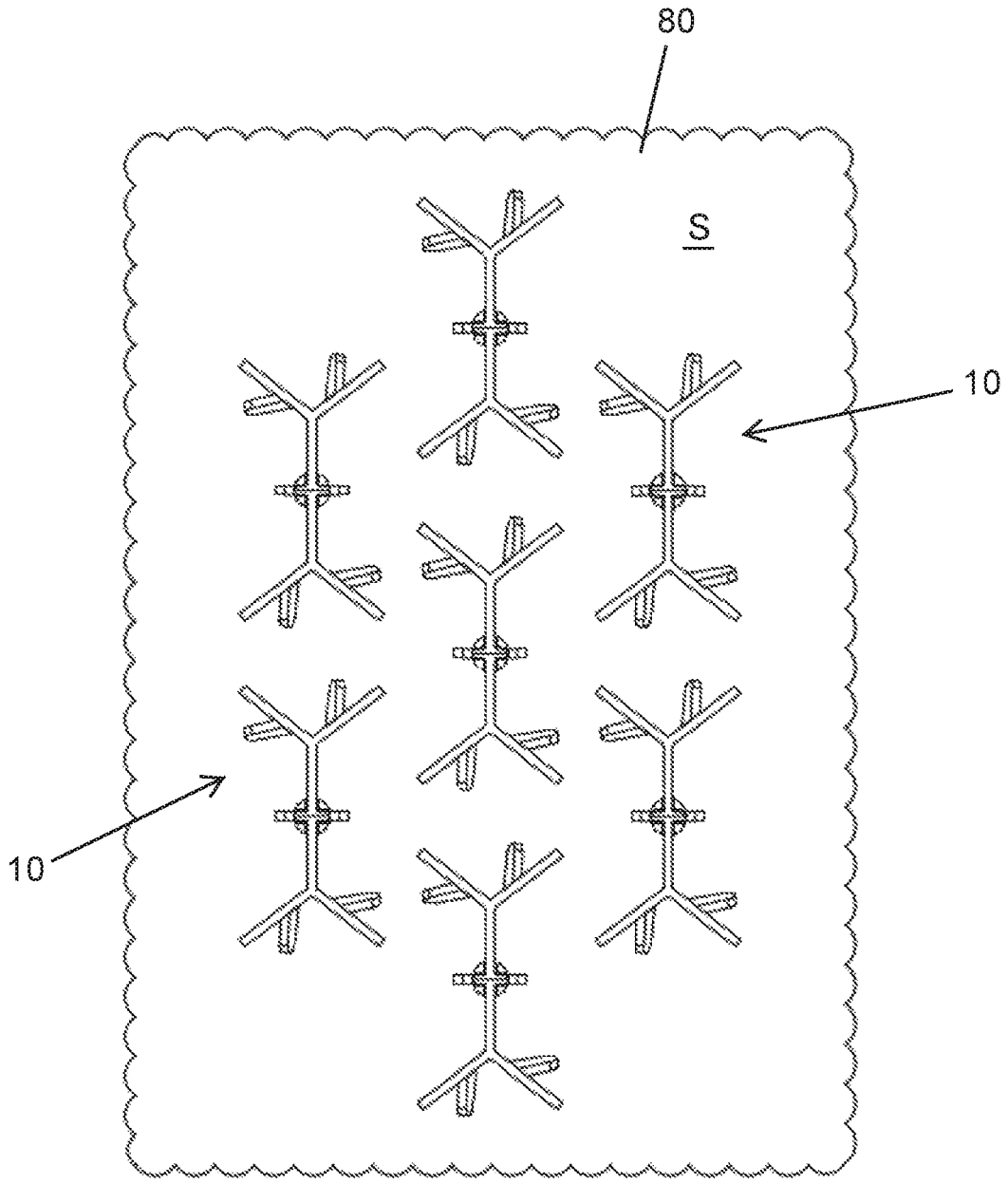
FIG. 7 is a plan view showing an array of the anchors of FIG. 1 attached to a metal substrate.

Referring now to FIG. 7, there is shown an array of anchors 10 connected to the surface S of substrate 80. The array of anchors 10 shown in FIG. 7 is one of several that could be employed either in new construction or in repair work. For example, assuming FIG. 7 represents a repair section on substrate 80 and further assuming that the initial refractory anchorage was comprised of hexagonal stud grating, the angular displacement of the wings of the end portions could be positioned adjacent a hexagonal stud grate and the obtuse angle between the various wing portions of anchor 10 could be such that they approximate a regular hexagon's interior angles permitting matching of the anchors 10 with the remaining hex shapes in a patch. However, it is to be understood that the anchors of the present invention can be used in the installation of new refractory and form the sole anchorage system for such new refractory.

In addition to the advantages noted above regarding the single weld to connect the anchors to the substrate, the ability to uniformly apply any suitable refractory over the surface S of a metal substrate 80, the angle of the tabs on the wings as discussed above providing upwardly and downwardly facing surfaces which can serve to resist radially inwardly directed forces caused by the heating of the refractory as well as radially outwardly directed forces which could be encountered when the vessel or the like to which the refractory is attached is under high pressure.

Further, the monolithic structure of the anchor avoids the manual labor required to clip the two pieces of the anchor disclosed in the 789 Patent together, and further minimizes labor by requiring only a single weld for each anchor to be attached to the surface S of a metal substrate 80 forming the wall of a metal vessel.

It has been found that an anchor 10 having certain physical characteristics is ideally suited for repair as well as new refractory construction. In this regard, anchor 10 wherein the bridge 12 is about 2" long and has a height of from about 0.5" to about 1.5" is preferred. In this regard, and when viewed in side elevation as shown in FIG. 3, it can be seen that the bridge 12 varies in height and such variance can be from about 0.5" to about 1.5". The length of the wings from their outer edges to the vertex can have a length of about 1.25", the wings having a height of 1" although as shown again in side elevation, each of the wings in addition to the foot portions described above have tapered surfaces which extend from the bottom surface of the feet to the vertice, the vertice having a height equal to the maximum height of the bridge section 12. Again, this allows maximum amount of refractory to be applied to the surface S of the substrate 80.

Further preferred dimensions include the outermost tips of the wings on both sides of the bridge 12 being spaced apart about 3.5". The apertures in the bridge portion 12 can be any shape but in particular can be rectangular having a dimension of from about 0.125" to about 0.25".

As noted above, the angles between the wings and the bridge portion are generally about 127° but can vary in a range of 100° to 140°. Lastly, the diameter of the pedestal 60 above the bottommost section is about 0.5".

It will be recognized that the above dimensions, angles, and other physical parameters, while being one preferred form of the anchor of the present invention can vary provided that the refractory holding formations, such as the apertures, tabs, etc, are sized/formed to result in maximum adherence of refractory material to the anchor.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A refractory anchor comprising:

a monolithic metallic structure, said monolithic metallic structure comprising:

a bridge portion having a first end, a second end, a top surface, and a bottom surface;

a pedestal having a portion extending downwardly from said bridge portion between said first and second ends, said pedestal being bifurcated and having a first fork formed on said first side of said bridge portion, and a second fork formed on said second side of said bridge portion, and wherein there is a first fork tab extending laterally outwardly from said first fork, and a second fork tab extending laterally outwardly from said second fork, said first and second forks having free ends;

a first V-shaped end portion having first and second wing portions connected by a first vertex portion having a first vertice, said first vertice being connected to said first end of said bridge portion, each of said first and second wing portions having first and second bottom wing surfaces;

a second V-shaped end portion having third and fourth wing portions connected by a second vertex portion having a second vertice, said second vertice being connected to said second end of said bridge portion, each of said third and fourth wing portions having third and fourth bottom wing surfaces, each of said first, second, third, and fourth wing portions having laterally outwardly projecting tabs and apertures extending therethrough;

said pedestal having a bottommost portion having a bottommost surface extending below the bottom surfaces on said first, second, third, and fourth wing portions, the bottommost surface of said pedestal having a downwardly extending weldable formation cast monolithically with and made of the same metal as said structure, the weldable formation comprising a nub.

2. The anchor of claim 1, wherein said bridge portion has first and second apertures therethrough.

3. The anchor of claim 1, wherein said first and second wing portions on said first V-shaped end portion are at obtuse angles to said bridge portion, and said third and fourth wing portions on said second V-shaped end portion are at obtuse angles to said bridge portion.

4. The anchor of claim 3, wherein said obtuse angles are from about 100° to about 140°.

5. The anchor of claim 3, wherein said obtuse angles are from about 125° to about 135°.

6. The anchor of claim 3, wherein said obtuse angles are about 127°.

7. The anchor of claim 1, wherein said first wing portion has a first side and a second side, and there is a first tab extending from said first side, and said second wing portion has a third side and a fourth side, and there is a second tab extending from said fourth side.

8. The anchor of claim 7, wherein said third wing portion has a fifth side and a sixth side, and there is a third tab extending from said sixth side, and said fourth wing portion has a seventh side and an eighth side, and there is a fourth tab extending from said seventh side.

9. The anchor of claim 8, wherein each of said wing portions has an aperture extending therethrough.

10. The anchor of claim 1, wherein said bottom wing surfaces are generally coplanar.

11. The anchor of claim 1, wherein said bridge portion has a first side and a second said and said pedestal is bifurcated having a first fork formed on said first side of said bridge portion, and a second fork formed on said second side of said bridge portion.

12. The anchor of claim 11, wherein there is a first fork tab extending laterally outwardly from said first fork, and a second fork tab extending laterally outwardly from said second fork, each of said tabs having a free end.

13. The anchor of claim 1, wherein said structure has a generally elongated X shape.

* * * * *